US006016822A

United States Patent [19]

Lin et al.

[11] Patent Number: 6,016,822

[45] Date of Patent: Jan. 25, 2000

[54] AUTOMATIC UMBRELLA WITH QUADRUPLE FOLDS OR THE LIKE

[75] Inventors: Chung-Kung Lin, Taipei; Jung-Jen Chang, Taipei Hsien, both of Taiwan

[73] Assignee: Fu Tai Umbrella Works, Ltd., Taipei Hsien, Taiwan

[21] Appl. No.: 09/071,439

[22] Filed: May 1, 1998

[51] Int. Cl.[7] ..... A45B 25/14

[52] U.S. Cl. ..... 135/24; 135/20.3; 135/29; 135/37

[58] Field of Search ..... 135/22, 23, 240, 135/25.4, 25.41, 25.1, 28, 31, 37, 20.3, 29

[56] References Cited

U.S. PATENT DOCUMENTS

| | | | |
|---|---|---|---|
| 5,390,686 | 2/1995 | Lin et al. | 135/24 |
| 5,441,065 | 8/1995 | Lin et al. | 135/24 |
| 5,492,140 | 2/1996 | Lin et al. | 135/24 |
| 5,505,222 | 4/1996 | Lin et al. | 135/24 |
| 5,617,889 | 4/1997 | Wu | 135/22 |
| 5,626,161 | 5/1997 | Lin et al. | 135/24 |

*Primary Examiner*—Carl D. Friedman
*Assistant Examiner*—Yvonne Horton-Richardson

[57] ABSTRACT

An automatic umbrella includes: a central shaft consisting of four tubes telescopically engageable with one another; a rib assembly consisting of at least a top rib pivotally secured to a top portion of the central shaft, a stretcher rib pivotally connected with the top rib and a lower runner slidably held on the central shaft, and several ribs pivotally connected to the top rib and the stretcher rib; an opening spring resiliently retained in the central shaft for opening the umbrella; a plurality of closing springs secured on the rib assembly for closing the umbrella; and a control device consisting of an upper roller rotatably mounted on an upper portion of the central shaft, a lower roller rotatably secured on the lower runner and an uppermost roller rotatably secured on a top portion of the shaft for continuously deflectively winding a rope of the control device on the rollers for making an automatic umbrella of quadruple folds or the like.

12 Claims, 10 Drawing Sheets

10
15
25
565
161
151
563
21
16
4
27
56
42
32
41
561
29
552
24
26
28
1
17
22
562
564a
564
2
55
27a
3
23
120
11
31
511
10a
14
120a
52a
124
13
50
511a
13a
12
572
231
111a
B
51a
A
57

54
571
551
53
573
57a

AUTOMATIC UMBRELLA WITH QUADRUPLE FOLDS OR THE LIKE

BACKGROUND OF THE INVENTION

U.S. Pat. No. 5,626,161 (hereinafter called "prior art") to the same inventors of this application disclosed an automatic umbrella having triple folds for folding the umbrella ribs and the tubes of the central shaft. If it is intended to apply the mechanism of the prior art to be a quadruple-fold automatic umbrella which is folded to minimize its folding volume, it may incur a big problem for accommodating or winding the rope (56) within the umbrella structure when the rib assembly (2) and the telescopic central shaft (1) are retracted since there are just provided with two rollers including the upper roller (563) and the lower roller (564) for winding the rope (56) thereon.

Meanwhile, the control means (5) of the prior art for controlling the opening and closing of the umbrella is still complex and can be further simplified to minimize the elements in construction of the control means (5) in order to decrease the volume and weight of the complete set of the umbrella when the prior art is improved to be a quadruple-fold automatic umbrella.

The present inventor has found these drawbacks of the conventional automatic umbrella, and invented the present quadruple-fold automatic umbrella.

SUMMARY OF THE INVENTION

The object of the present invention is to provide an automatic umbrella including: a central shaft consisting of four tubes telescopically engageable with one another; a rib assembly consisting of a top rib pivotally secured to a top portion of the central shaft, a stretcher rib pivotally connected with the top rib and a lower runner slidably held on the central shaft, a middle rib outwardly connected to a tail rib by means of an outer spring rib and an outer connecting rib, with the middle rib inwardly connected to the stretcher rib and the top rib by means of an inner connecting rib, and an inner spring rib connected between the stretcher rib and the outer connecting rib; an opening spring resiliently retained in the central shaft for opening the umbrella; a plurality of closing springs secured on the rib assembly for closing the umbrella, and a control device consisting of an upper roller rotatably mounted on an upper portion of the central shaft, a lower roller rotatably secured on the lower runner and an uppermost roller rotatably secured on a top portion of the shaft for winding a rope of the control device for making an automatic umbrella of quadruple folds.

DETAILED DESCRIPTION

Figures 1, 2, 2A:
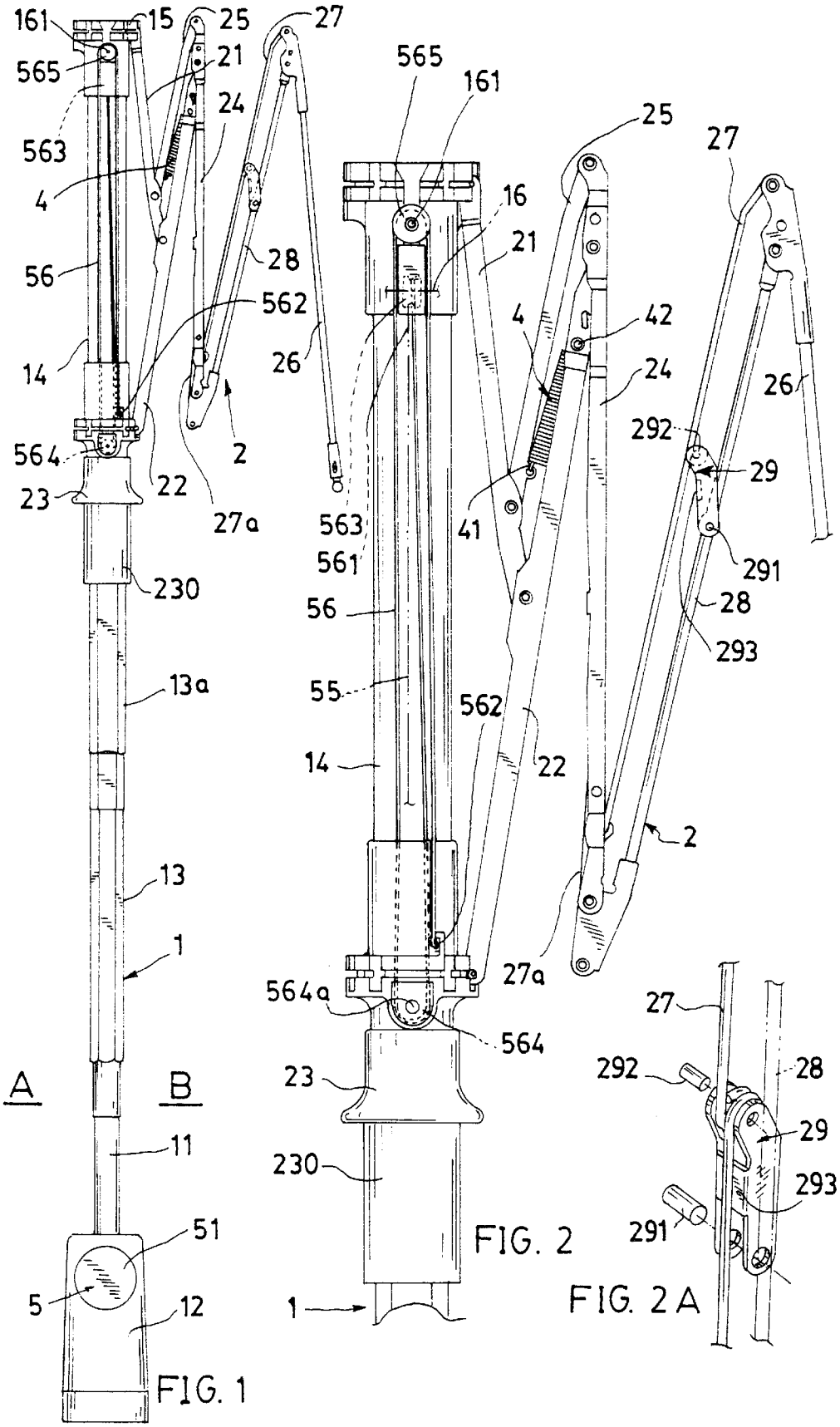
FIG. 1 shows an automatic umbrella of the present invention when the rib assembly is retracted.
FIG. 2 is a partial enlarged illustration of the umbrella of FIG. 1.
FIG. 2A shows a coupling for connecting the outer spring rib with the outer connecting rib of the present invention.

As shown in FIGS. 1–15, the present invention comprises: a central shaft means 1, a rib assembly 2, an opening spring 3, a plurality of closing springs 4, and a control means 5. The central shaft means 1 includes: a lower tube 11, a grip 12 secured to a lower tube portion 111 of the lower tube 11, a first middle tube 13 slidably held on an outer and upper side of the lower tube 11, a second middle tube 13*a* slidably held on an outer and upper side of the first middle tube 13, an upper tube 14 slidably held on an outer and upper side of the second middle tube 13*a*, an upper notch 15 secured on a top portion of the upper tube 14, and a central sleeve set 17 including an upper sleeve section 171, a middle sleeve section 172, and a lower sleeve section 173 telescopically coupled with one another having an uppermost sleeve portion 171*a* of the upper sleeve section 171 contiguous to an upper portion of the upper tube 14.

The rib assembly 2 includes: a top rib 21 having an inner portion of the top rib 21 pivotally secured to the upper notch 15 of the central shaft means 1, a stretcher rib 22 having a middle rib portion connected with an outermost end of the top rib 21 and having an inner portion of the stretcher rib 22 pivotally secured to a lower runner 23 which is slidably held on the upper tube 14 and having an outermost rib end of the stretcher rib 22 pivotally connected with an inner portion of a middle rib 24, the middle rib 24 having an innermost end of the middle rib 24 pivotally connected with an outer end of an inner connecting rib 25, having an inner end of the inner connecting rib 25 connected with an outer portion of the top rib 21, a tail rib 26 having an innermost end of the tail rib 26 pivotally connected with an outer end of an outer spring rib 27 with the outer spring rib 27 having an inner end thereof pivotally connected with an outer portion of the middle rib 24, an inner spring rib 27*a* juxtapositionally held to the middle rib 24 and connected between an innermost end of an outer connecting rib 28 and an outer portion of the stretcher rib 22, the outer connecting rib 28 juxtapositionally coupled with the outer spring rib 27 by a coupling 29, having an inner portion of the outer connecting rib 28 pivotally connected with an outermost end of the middle rib 24 and having an outer end of the outer connecting rib 28 pivotally connected to an inner portion of the tail rib 26.

Other mechanisms of the ribs can be modified. The lower runner 23 has a lower extension tube 230 protruding downwardly from the runner 23 having a slot 231 cut in the extension tube 230.

The coupling 29 as shown in FIGS. 2, 2A, 3, and 3A includes a pivot 291 formed on a base of the coupling for pivotaly securing the coupling 29 on the outer connecting rib 28, a pin 292 formed on an upper end of the coupling for pivotally connecting a middle loop formed on a middle portion of the outer spring rib 27, and a seat portion 293 formed on a central portion of the coupling for resting the outer spring rib 27 thereon when the umbrella is folded (FIG. 2A). The spring rib 27 may also be separated as two spring sections to be commonly coupled to the pin 292 of the coupling.

Another preferred embodiment of the coupling 29 is shown in FIGS. 6A–6D, which includes:a pivot 291 formed on a base of the coupling for pivotally securing the coupling on the outer connecting rib 28, and an U-shaped collar 292*a* formed on an upper end of the coupling for slidably fastening the outer spring rib 27 within a hole 293*a* defined within the collar 292*a*.

The coupling 29 of the present invention will couple the outer spring rib 27 with the outer connecting rib 28 to prevent twisting, tangling or inversion of the two ribs 27, 28 for a smooth folding and unfolding operation of the rib assembly 2.

The central shaft means 1 includes: the lower tube 11 having an upper enlarged portion 112 having a cross section of hexagonal shape to be engageable with the first middle tube 13 having a cross section of hexagonal shape, the first middle tube 13 having an upper enlarged portion 132 having a cross section of triple-lobe shape to be engageable with the second middle tube 13*a* having a cross section of triple-lobe shape and having a lower tube end 131 tapered downwardly to have a cross section of circular shape to be engageable with the lower tube 11, the second middle tube 13*a* having a lower tube end 131*a* tapered downwardly and having a cross section of hexagonal shape to be engageable with the first middle tube 13 and having an upper enlarged portion 132*a* having a cross section of circular shape to be engageable with the upper tube 14 having a cross section of circular shape, and the upper tube 14 having a lower tube end 141 tapered downwardly to have a cross section of triple-lobe shape to be engageable with the second middle tube 13*a*.

Other cross sectional shapes of the tubes of the central shaft means 1 may be further modified in the present invention.

The opening spring 3 for opening an umbrella of this invention has a lower spring end 31 retained on a lower protrusion portion 10*a* of the lower tube 11, and an upper spring end 32 retained on a bottom portion of an inner block 151 inserted in an upper portion of the upper tube 14, the opening spring 3 slidably disposed about the central sleeve set 17.

Each closing spring 4 of the plurality of the closing springs 4 has an inner spring end 41 of the closing spring 4 secured to an inner portion of the inner connecting rib 25, and an outer spring end 42 of the closing spring 4 secured to an outer portion of the stretcher rib 22. The closing spring 4 is provided for closing an umbrella from its opened state by an elastic energy stored when opening the umbrella. The closing spring 4 may also be installed on the other locations of the rib assembly 2.

Figure 6:
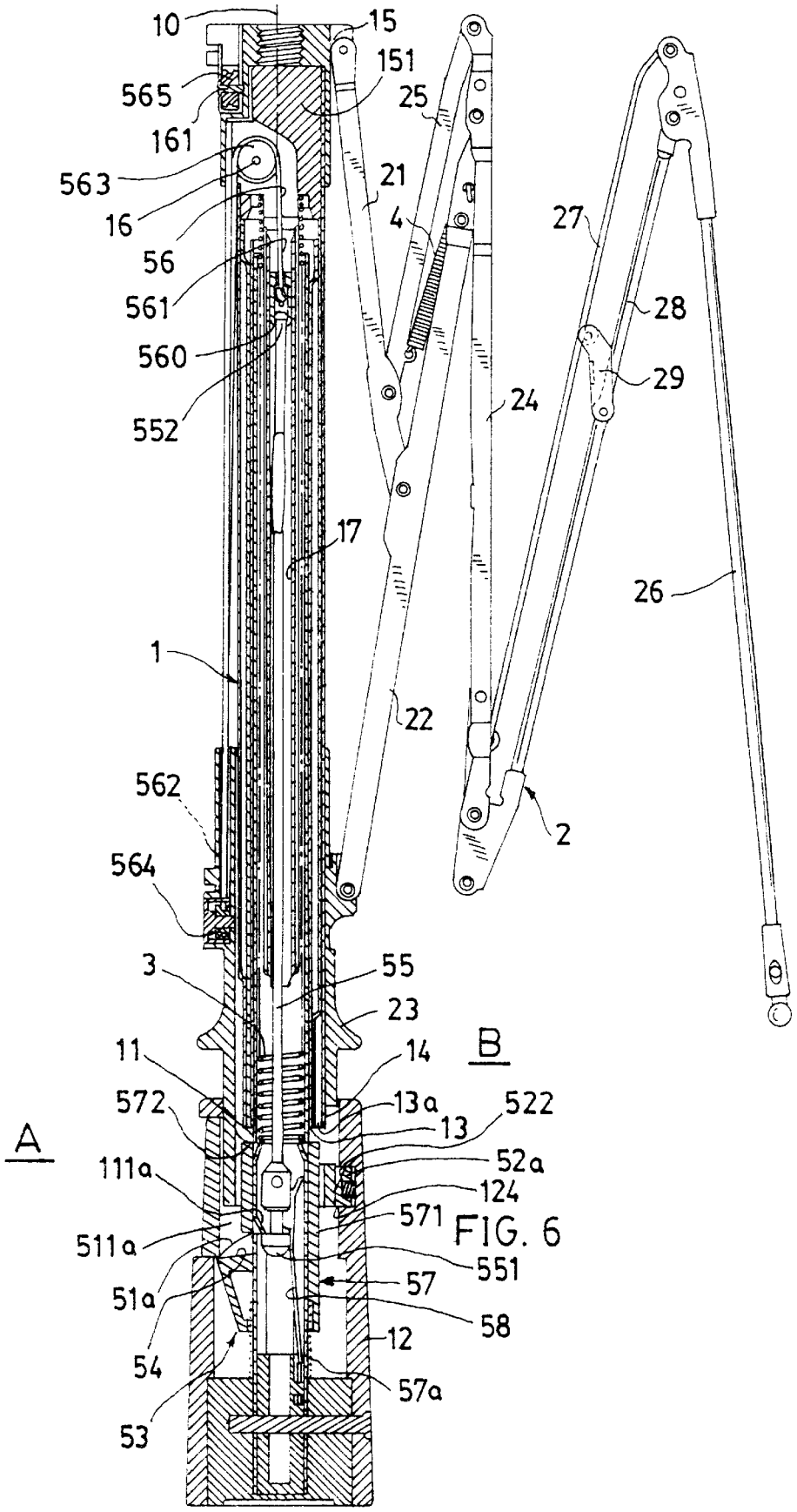
FIG. 6 shows a depression of the push button when opening the umbrella.
Figure 6A:
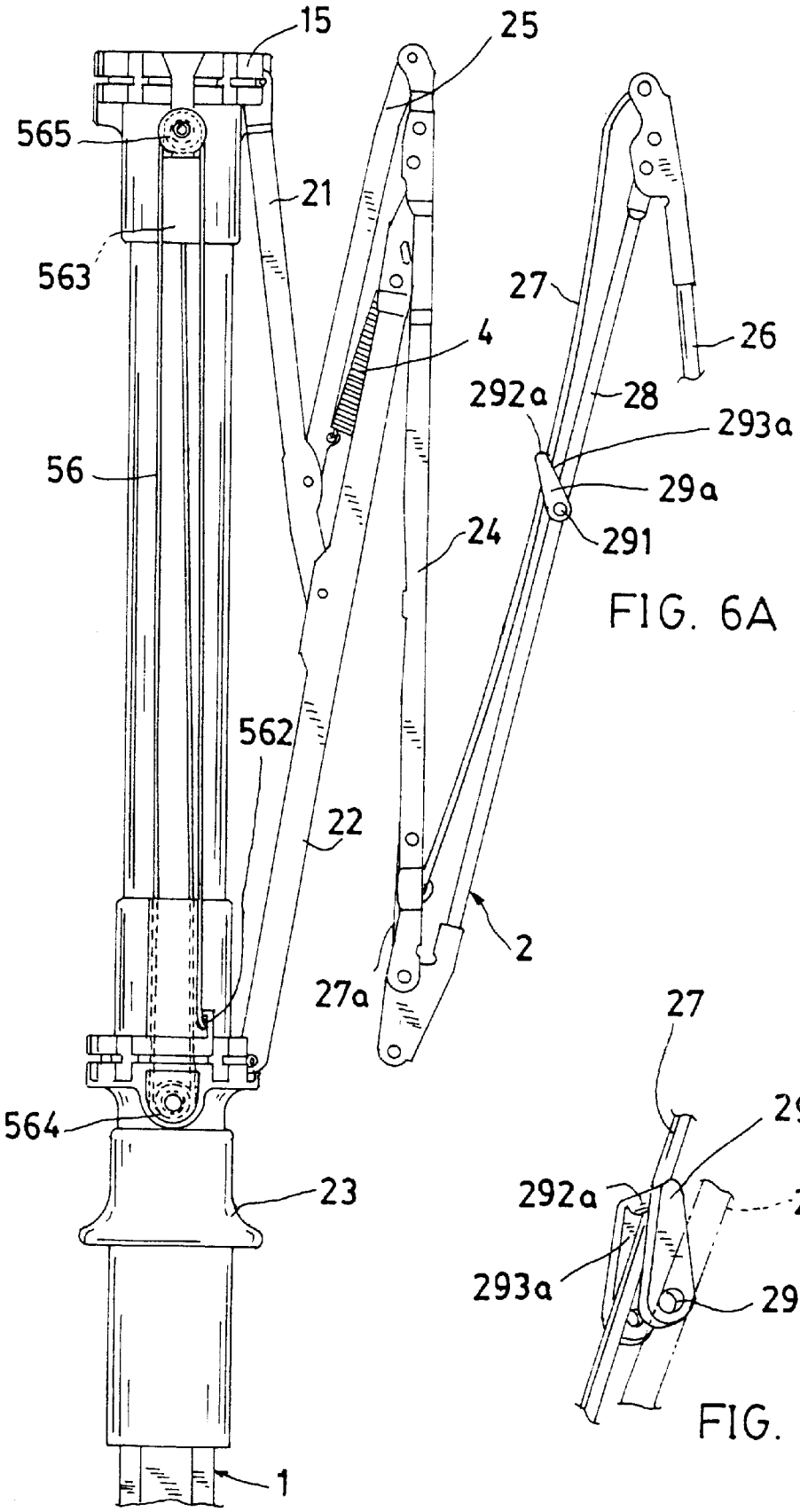
FIG. 6A shows a folded umbrella of the present invention by using another preferred embodiment of the coupling.
Figure 6B:
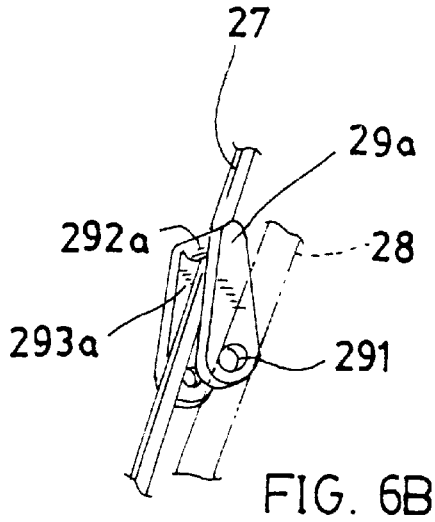
FIG. 6B is an illustration of the coupling as shown in FIG. 6A.
Figures 6C, 6D:
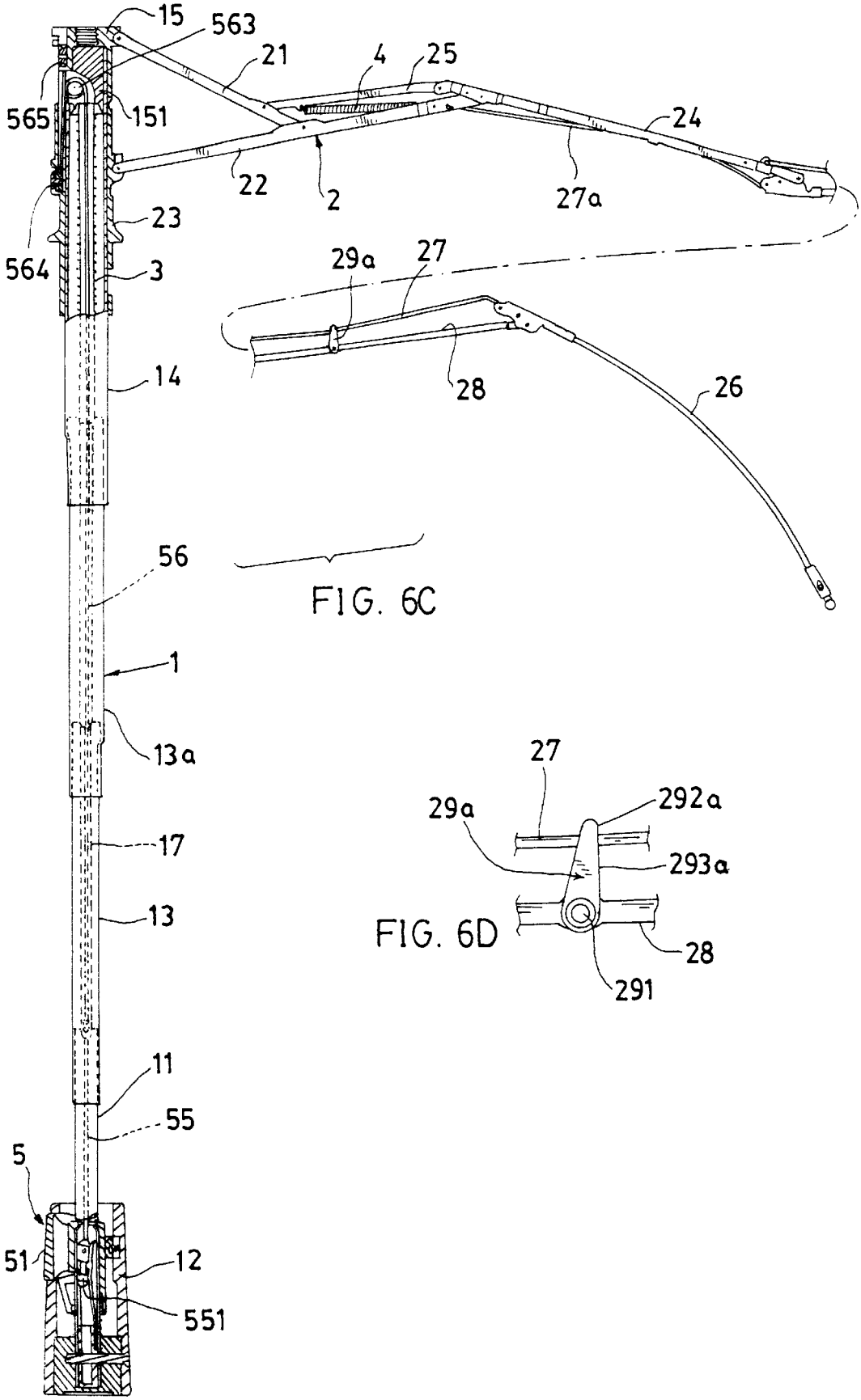
FIG. 6C shows an open umbrella from FIG. 6A.
FIG. 6D is a partial illustration of the rib assembly and the coupling as shown in FIG. 6C.
Figure 7:
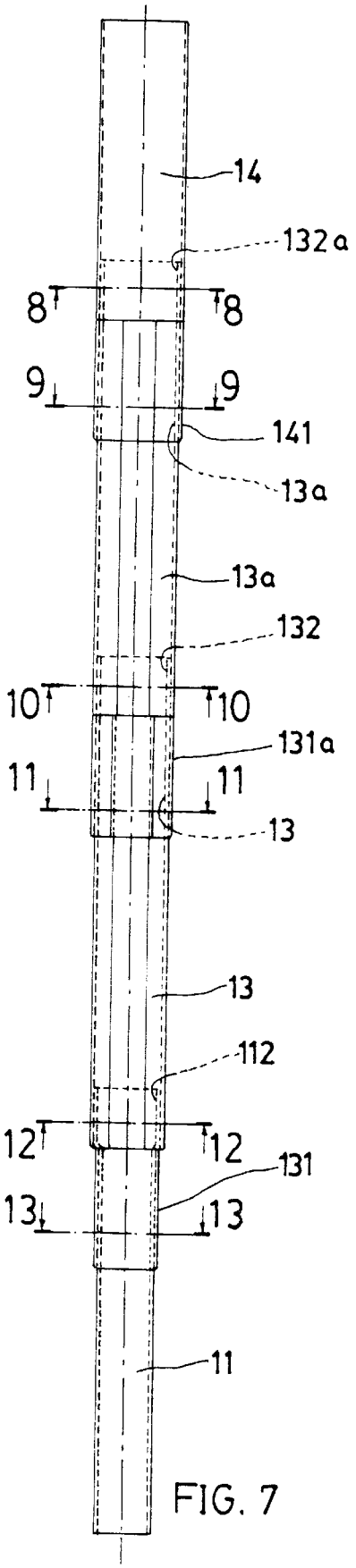
FIG. 7 is an illustration of the central shaft means of the present invention.
Figure 8:
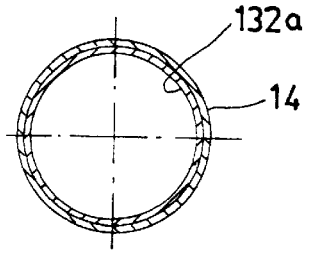
FIG. 8 is a cross sectional drawing when viewed from 8—8 direction of FIG. 7.
Figure 9:
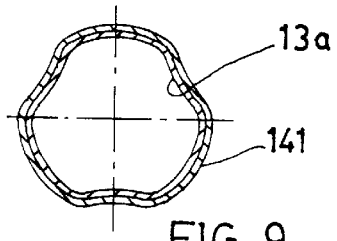
FIG. 9 shows a cross section when viewed from 9—9 direction of FIG. 7.
Figure 10:
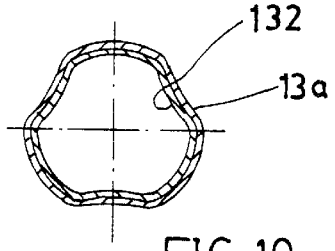
FIG. 10 is a cross section from 10—10 direction of FIG. 7.
Figure 11:
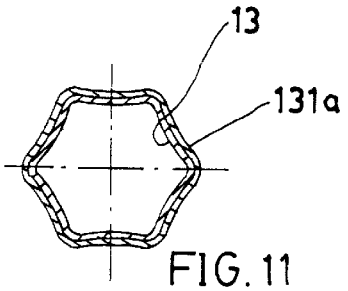
FIG. 11 is a cross section from 11—11 direction of FIG. 7.
Figure 14:
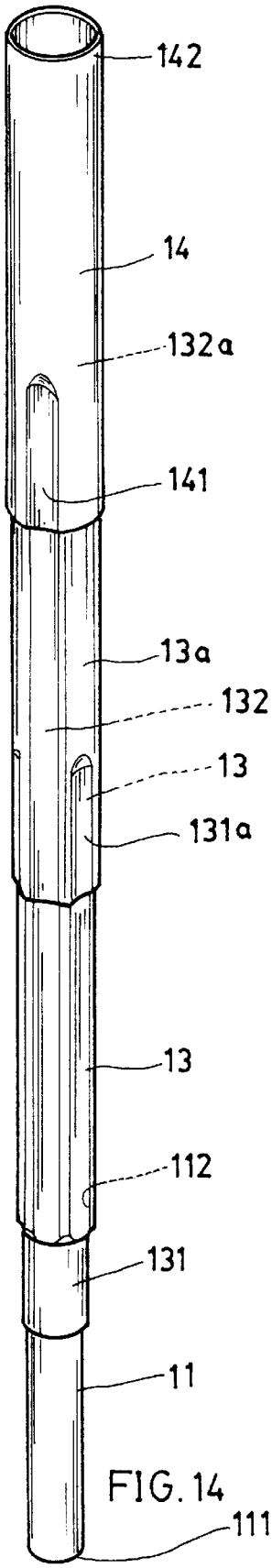
FIG. 14 is a perspective view of the central shaft means.
Figure 15A:
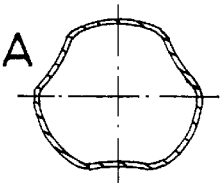
FIG. 15A is a cross section of triple-lobe tube of the shaft means of this invention.
Figure 12:
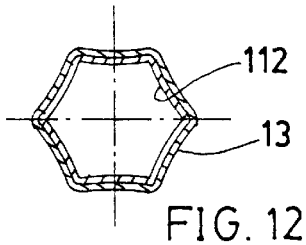
FIG. 12 shows a cross section from 12—12 direction of FIG. 7.
Figure 13:
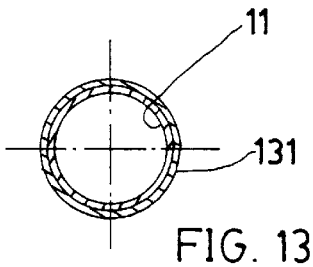
FIG. 13 shows a cross section from 13—13 direction of FIG. 7.
Figure 15:
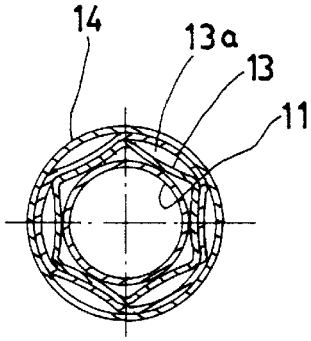
FIG. 15 is a cross sectional drawing of the central shaft means when folded.

The control means 5 includes: a push button 51 resiliently held in a button hole 120*a* formed in the grip 12 having an upper latch 52*a* integrally formed on a ring portion 511 which is slidably held in at least a guiding groove 124 transversely recessed in an inside wall of the grip 12, with the ring portion 511 tapered from the push button 51 from a first side A of the central shaft means 1 towards a second side B of the shaft means 1 to form a pair of reinforced side-wing portions 51*a* disposed on opposite sides of the push button 51 and each wing portion 51*a* defined between the push button 51 and the ring portion 511, and having the upper latch 52*a* operatively actuated when simultaneously depressing the push button 51 for opening the umbrella, a closing controller 53 having a lower latch 54 resiliently secured on an anti-false operation safety means 57 resiliently held in the grip 12 and the lower latch 54 being operatively depressible by the push button 51 for inwardly pushing a locking head 551, which is secured with a drag rod 55 coupled to a drag rope 56 which is repeatedly linked between an upper portion of the upper tube 14 and the lower runner 23, for disengaging the locking head 551 from a detent protrusion 111*a* formed in a lower portion 111 of the lower tube 11, thereby allowing each said closing spring 4 to be restored to release its pre-stored elastic energy for closing the umbrella from an opened state, with the anti-false operation safety means 57 having an elongated cylinder 571 lowered by the two middle tubes 13, 13*a* after closing the umbrella to lower the latch 54 to prevent a false depression of the closing controller 53 without being depressed by the push button when opening the umbrella as shown in FIG. 6.

Figure 5:
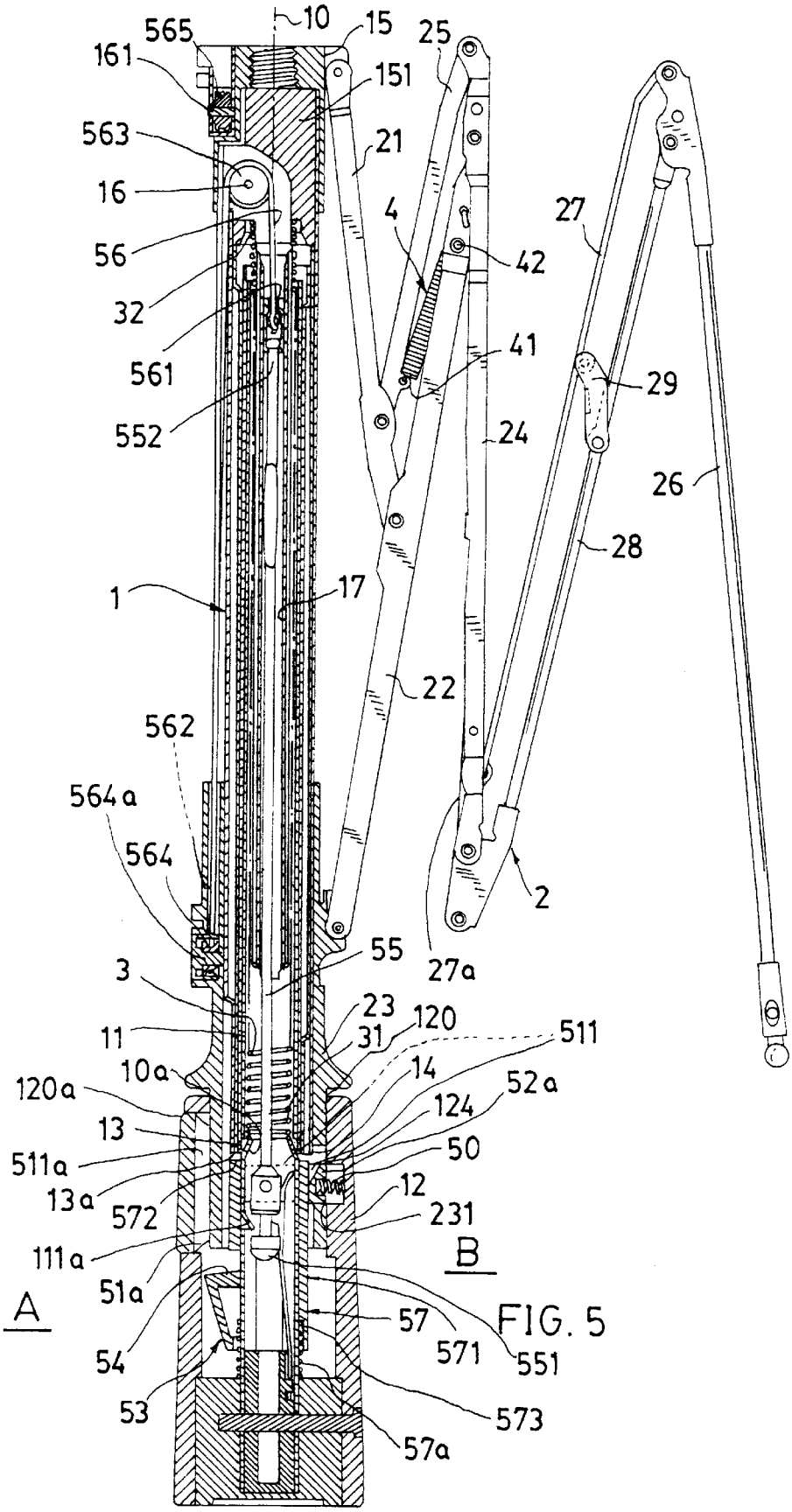
FIG. 5 is a sectional drawing of the present invention when folded ready for opening the umbrella.

The upper latch 52*a* as integrally formed on the ring portion 511 of the push button 51 includes: a sloping latch portion 522, adjacent to the second side B of the shaft means 1, operatively depressed and retracted by the lower runner 23 when closing the umbrella, and the upper latch 52*a* having a spring socket recessed therein adjacent to the second side B of the shaft means 1 to be resiliently urged towards the first side A of the shaft means 1 by a restoring spring 50 retained in the grip 12 adjacent to the second side B of the shaft means 1 to be engageable with the slot 231 formed in the lower runner 23 for locking the umbrella at its folded state (FIG. 5).

The push button 51 has the ring portion 511 formed with a central hole 511*a* in a central portion of the ring portion 511 for downwardly passing the lower extension tube 230 of the lower runner 23 which is disposed around a bottom tube portion of each upper tube 14 and the middle tubes 13, 13*a* when folding the central shaft means 1 for closing the umbrella (FIG. 5). The sloping latch portion 522 is tapered downwardly from an upper rim surface of the ring portion towards the central hole 511*a* to be thrusted or retracted when lowering the runner 23 for closing the umbrella. The restoring spring 50 will then urge the upper latch 52*a* for engaging the slot 231 in the runner 23 for locking the umbrella at its folded or closed state.

Figures 3, 3A, 4:
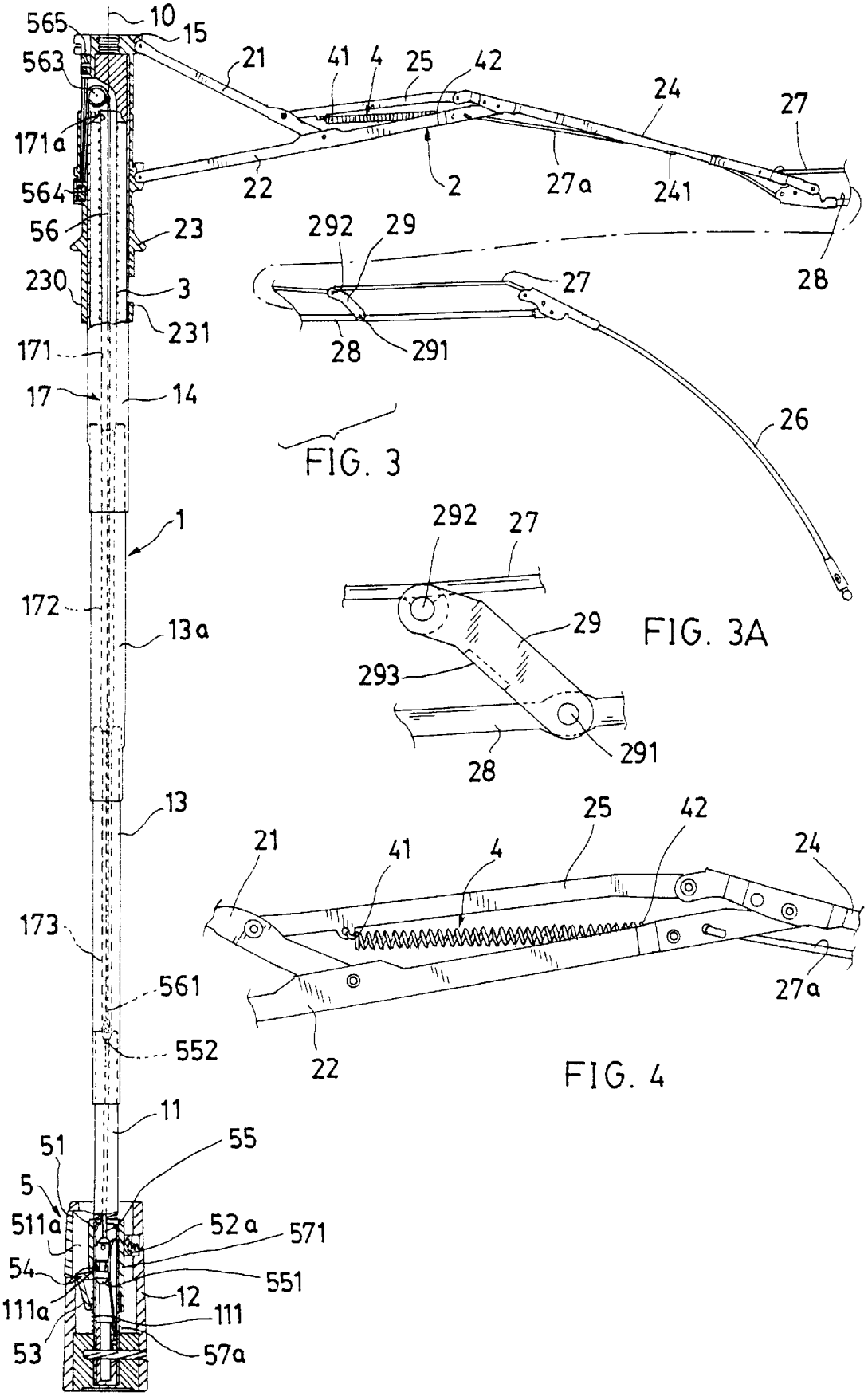
FIG. 3 is an illustration of an open umbrella of the present invention.
FIG. 3A is a partial illustration of the rib assembly of FIG. 3 including the coupling.
FIG. 4 is a partial illustration of the closing spring on the rib assembly of the present invention.

Upon an inward depression of the push button 51 to retract the upper latch 52*a* for disengaging the upper latch 52*a* from the slot 231 of the lower runner 23, the umbrella will be opened because the tubes of the shaft means 1 and the lower runner 23 are resiliently tensioned by the opening spring 3 (FIG. 3).

The closing controller 53 includes: the lower latch 54 resiliently secured to a lower portion of an elongated cylinder 571 of the anti-false operation safety means 57, with the elongated cylinder 571 resiliently raised upwardly as urged by a tension spring 57*a* which is retained in a bottom spring socket 573 recessed in a bottom of the cylinder 571 to position the lower latch 54 in between the push button 51 and a locking head 551 secured with the drag rod 55 when opening the umbrella as shown in FIG. 3, with the central hole 511*a* in the ring portion 511 allowing an upwardly moving of the cylinder 571 and the lower latch 54 because the cylinder 571 is urged by the tension spring 57*a* after opening the umbrella to extend the upper and middle tubes 14, 13, 13*a* upwardly and raise the runner 23 as shown in FIGS. 3, whereby upon depression of the push button to inwardly push the lower latch 54 and the locking head 551 through a latch hole formed in the lower tube 11, the locking head 551 will be disengaged from the detent protrusion 111*a* in the lower tube 11 for closing an umbrella from an opened state.

The detent protrusion 111*a* is directly punched inwardly from a lower portion of the lower tube 11 for engaging the locking head 551 when closing the umbrella and compressing the spring 3 as being sidewardly biased towards the first side A of the shaft means 1 by a convex spring plate 58 formed in the grip 12 at the second side B of shaft means 1 (FIG. 5).

The drag rod 55 has a lower rod end secured to the locking head 551 and an upper rod end 552 coupled to an inner rope end 561 of the drag rope 56 through a coupling sleeve 560, with the drag rod 55 slidably held in the central sleeve set 17.

The drag rope 56 includes: an inner rope end 561 coupled to the drag rod 55 by the coupling sleeve 560, an outer rope end 562 fixed to the lower runner 23, an upper guiding roller 563 rotatably mounted by an upper pivot 16 in the inner block 151 secured in a an upper portion of the upper tube 14 for slidably guiding the drag rope 56 from inside the upper tube 14 and the central sleeve set 17 telescopically held within the lower tube 11, the middle tubes 13, 13*a* and the upper tube 14 and winding the rope on the upper guiding roller 563 with the rope then directed downwardly towards the lower runner 23 to be wound on a lower guiding roller 564 rotatably mounted on the lower runner 23 by a lower pivot 564*a*, an uppermost guiding roller 565 rotatably mounted on a top portion of the upper tube 14 by an uppermost pivot 161 and positioned above the upper roller 563 for further winding the rope 56 on the uppermost guiding roller 565 from the lower guiding roller 564, with the outer rope end 562 downwardly directed to be fixed to the lower runner 23. So, the rope 56 is first wound on the upper roller 563 from the inside of the shaft 1 and guided to the lower roller 564 on the runner 23 by winding the rope on the lower guiding roller 564 and then deflectively extended upwardly to be wound on the uppermost roller 565 and finally deflected downwardly to be fixed to the lower runner 23, thereby providing an enough stroke for the rope for quadruple folds of an automatic umbrella.

The anti-false operation safety means 57 includes: an elongated cylinder 571 slidably disposed around a lower portion of the lower tube 11 and resiliently rested on a tension spring 57*a* retained in a lower portion of the grip 12, the cylinder 571 having the lower latch 54 integrally formed on of the cylinder 571, whereby when closing the umbrella, the lower runner 23 is lowered to insert the extension tube 230 into the inner hole 120 of the grip and the central shaft means 1 is folded to lower the upper and middle tubes 14, 13, 13*a* to allow the bottom end of the middle tubes 13, 13*a* to downwardly press an annular top surface 572 of the cylinder 571 downwardly for compressing and restoring the spring energy of the tension spring 57*a* as shown in FIG. 5, whereby the runner 23 is locked by engaging the upper latch 52*a* with the slot 231 of the runner 23, and the lower latch 54 connected to the cylinder 571 is lowered to be positioned under the push button 51 as shown in FIG. 6 without being depressed by the push button. Therefore, upon depression of the push button 51 in order to open the umbrella, the lower latch 54 is positioned under and obstructed by the push button 51 to prevent unexpected actuation of the lower latch 54 of the closing controller 53 for preventing a false operation of the closing controller 53 when opening the umbrella. When the push button 51 is restored from FIG. 6 to FIG. 3, the push button 51 may then be further depressed to actuate the lower latch 54 to unlock the head 551 to close the umbrella.

When opening the umbrella of the present invention as shown from FIG. 5 to FIG. 3, the push button 51 is depressed to disengage the upper latch 52*a* from the slot 231 formed in the runner 23 to release the opening spring 3, which is previously compressed when re-setting the umbrella for storing the elastic energy of the opening spring, to extend the tubes 14, 13, 13*a*, 11 and raise the runner 23 and extend the ribs of the rib assembly 2 for opening the umbrella. The closing springs 4 are also tensioned to store their restoring elastic energy by the opening operation of the umbrella as effected by the opening spring 3.

When closing the umbrella from FIG. 3 to FIG. 5, the push button 51 is depressed to force the lower latch 54 of the closing controller 53 towards the second side B of shaft means 1 to disengage the locking head 551 from the detent protrusion 111*a* formed in the lower tube 11 to allow a downward movement of the runner 23 required for closing the umbrella, and the closing springs 4 will restore to lower the runner 23 to retract the ribs of the rib assembly 2 and fold the tubes 14, 13, 13*a*, 11. The lower latch 54 and the cylinder 571 will be moved upwardly as upwardly urged by the tension spring 57*a* to be positioned between the push button 51 and the locking head 551 after opening the umbrella and raising the tubes 14, 13, 13*a* (FIG. 3), thereby causing no obstruction for the inward depression of the push button 51 ready for a normal closing operation of the umbrella. For re-setting the folded or closed umbrella to store an elastic energy of the opening spring 3, the grip 12 may be depressed towards a tip portion of the umbrella for compressing the spring 3 ready for next opening use. In FIG. 5, the umbrella has already been reset by compressing the spring 3 ready for next opening operation. The cylinder 571 and the lower latch 54 is lowered below the push button 51, while the lower extension tube 230 of the lower runner 23 is disposed around an upper portion of the cylinder 571.

The uppermost guiding roller 565 as shown in FIGS. 2, 5 is rotatably mounted on a circumference of the top of the upper tube 14 by the uppermost pivot 161 which is generally projectively perpendicular to the upper pivot 16 having the upper guiding roller 563 rotatably mounted thereon and the uppermost pivot 161 is projectively parallel to the lower pivot 564*a* of the lower guiding roller 564.

Figure 16:
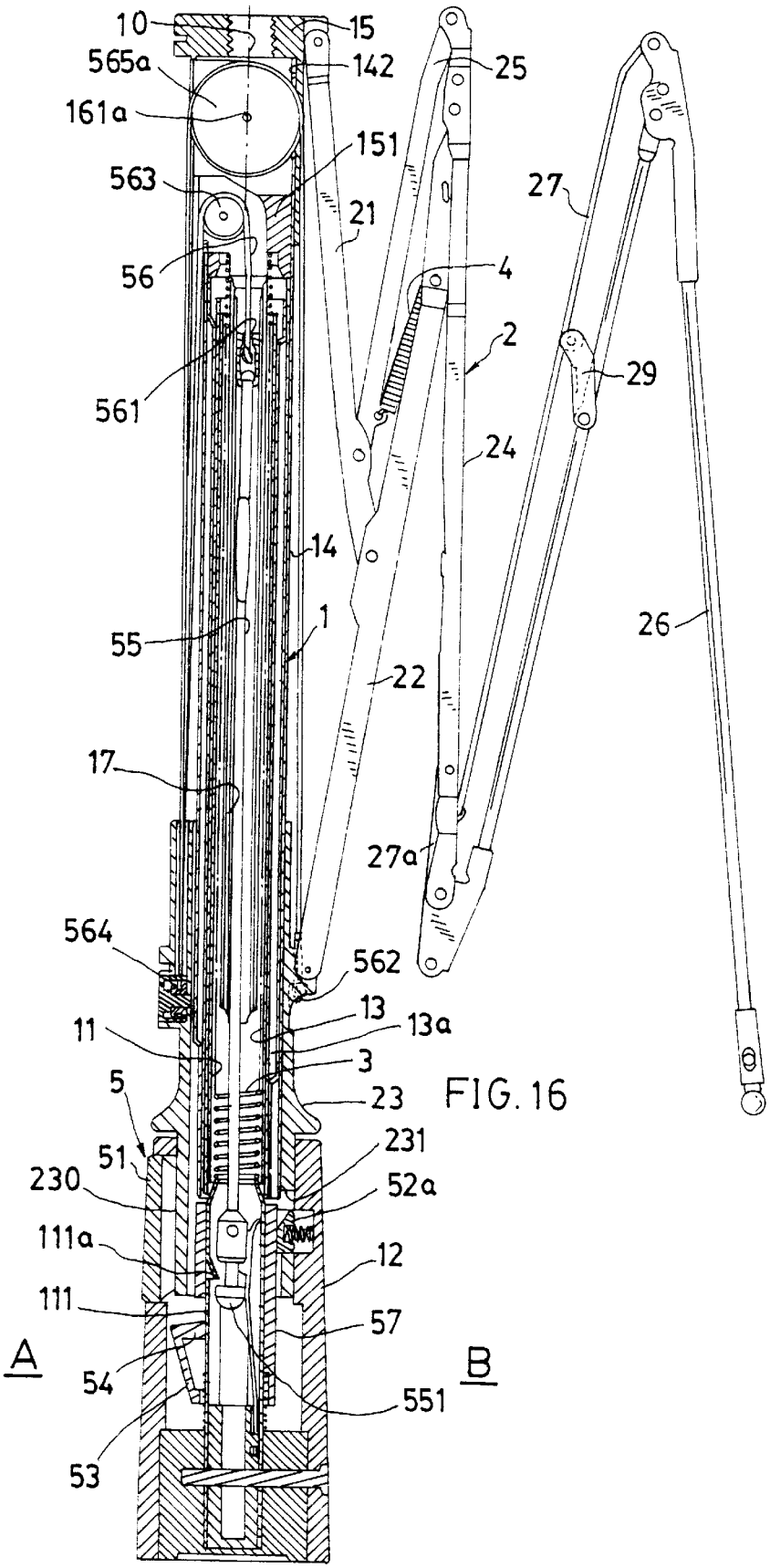
FIG. 16 shows another preferred embodiment of the present invention.

For further dynamically balancing the winding, tensioning and securing of the rope 56 on opposite sides about a pivot of the roller 565, the uppermost guiding roller 565 may be modified to be an uppermost guiding wheel 565*a* as shown in FIG. 16, in which the uppermost guiding wheel 565*a* has a diameter generally equal to a diameter of the upper tube 14 and rotatably mounted on the top of the upper tube 14 by an uppermost pivot 161*a* transversely secured on the top of the upper tube 14 and generally perpendicularly intersecting a longitudinal axis 10 of the shaft means 1 for symmetrically disposing an outer rope section of the rope 56 on opposite sides of the pivot 161*a* and disposed on opposite outer surfaces of the upper tube 14 for dynamic balancing of the rope stroke when folding and unfolding the umbrella.

Figure 17:
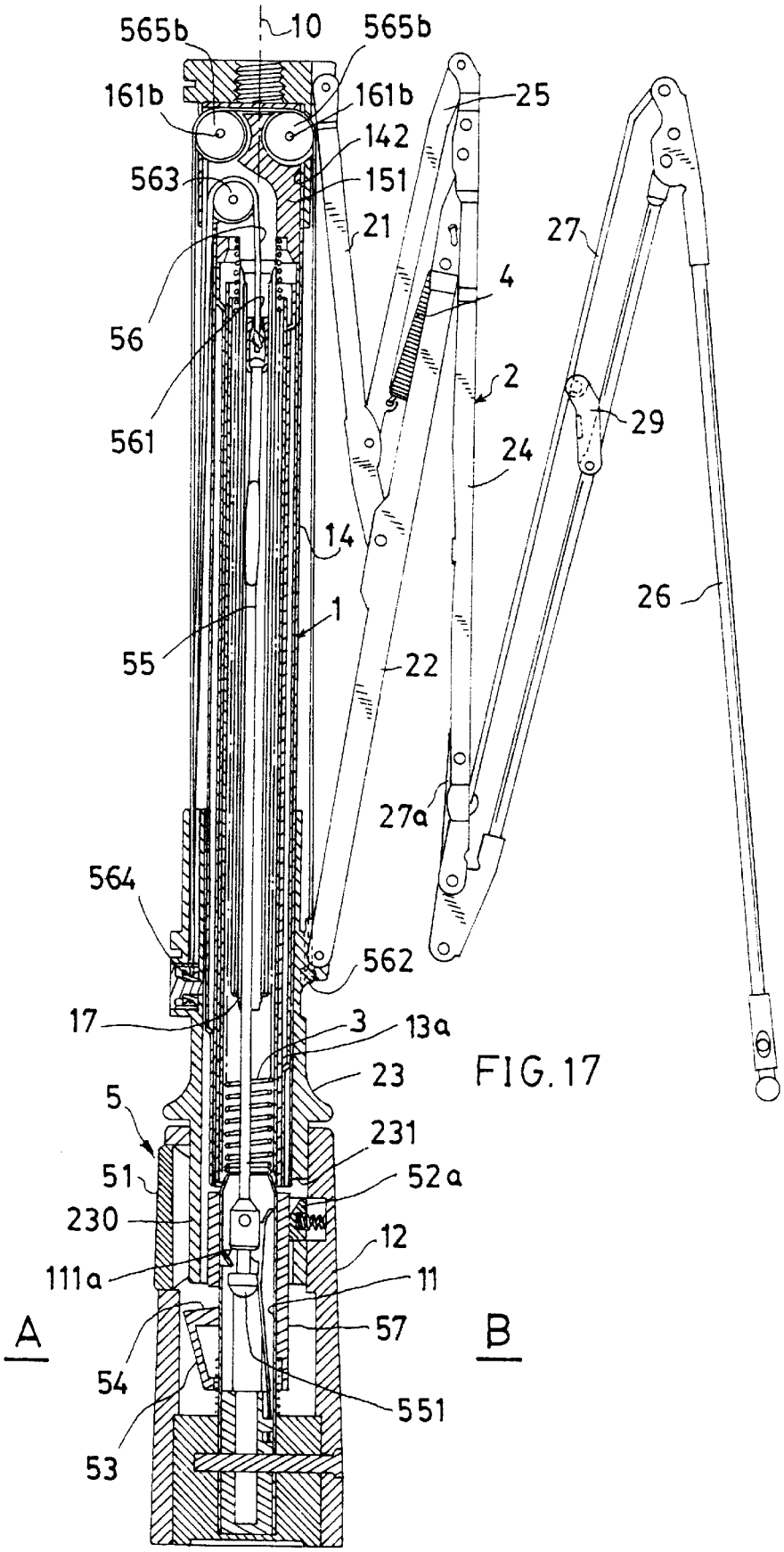
FIG. 17 shows still another preferred embodiment of the present invention.

As shown in FIG. 17, a pair of uppermost guiding rollers 565*b* are respectively rotatably mounted in opposite portions of the inner block 151 by two uppermost pivots 161*b* above the upper guiding roller 563 for winding the rope 56 on the two uppermost guiding rollers 565*b* for disposing the rope 56 on opposite outer surfaces of the upper tube 14 for dynamically balancing the rope stroke when operating the umbrella.

The uppermost guiding rollers 565, 565*a*, 565*b* may be designated as an "uppermost guiding means" including one roller (565, 565*a*) or a pair of rollers (565*b*) in the present invention.

The present invention is superior to the prior art of U.S. Pat. No. 5,626,161 since the present invention provides a plurality of guiding rollers 563, 564, 565, 565*a*, 565*b* for ensuring an enough stroke for the rope of an umbrella of quadruple folds or multiple folds. Meanwhile, the control means 5 for closing and opening the umbrella has been simplified for decreasing the volume and elements for miniaturizing the umbrella automallically closed and opened.

The present invention may be further modified without departing from the spirit and scope of the present invention.

We claim:

1. An automatic umbrella comprising:

a central shaft means including: a lower tube having a grip secured therewith, a first middle tube slidably held on said lower tube, a second middle tube slidably held on said first middle tube, and an upper tube slidably held on the second middle tube having an upper notch fixed on a top of the upper tube;

a rib assembly including at least a top rib pivotally secured to the upper notch, a stretcher rib pivotally connected to the top rib and a lower runner slidably held on the upper tube, a middle rib pivotally connected to said stretcher rib and said top rib by an inner connecting rib, a tail rib connected to the middle rib by an outer spring rib and an outer connecting rib coupled to said outer spring rib by a coupling, and an inner spring rib juxtapositioned to said middle rib and connected between the stretcher rib and the outer connecting rib;

an opening spring resiliently retained in said central shaft means for opening the umbrella;

a plurality of closing springs resiliently retained on said rib assembly for closing the umbrella; and a control means including a push button resiliently held in the grip, an upper latch normally locking the rib assembly and the central shaft means at a closed state and operatively actuated for extending the rib assembly and the shaft means for opening the umbrella, a closing controller having a lower latch formed on an anti-false operation safety means resiliently held in the grip and the lower latch operatively depressible by the push button for unlocking a locking head for closing the umbrella from an opened umbrella, said locking head secured to a drag rod coupled to a drag rope; with said drag rope having an inner rope section directed from an inner rope end coupled to said drag rod inside the shaft means and wound on an upper guiding roller rotatably mounted on an upper portion of the upper tube, and having an outer rope section of said drag rope downwardly directed from said upper guiding roller to be wound on a lower guiding roller rotatably mounted on said lower runner and then deflected upwardly to be wound on an uppermost guiding roller rotatably mounted on a top of said upper tube above said upper guiding roller and finally deflected downwardly to have an outer rope end fixed on said lower runner.

2. An automatic umbrella according to claim 1, wherein said coupling for coupling said outer spring rib and said outer connecting rib includes a pivot formed on a base of the coupling for pivotally securing the coupling on the outer connecting rib, a pin formed on an upper end of the coupling for pivotally connecting a middle loop formed on a middle portion of the outer spring rib, and a seat portion formed on a central portion of the coupling for resting the outer spring rib thereon when the umbrella is folded.

3. An automatic umbrella according to claim 1, wherein said coupling includes: a pivot formed on a base of the coupling for pivotally securing the coupling on the outer connecting rib, and an U-shaped collar formed on an upper end of the coupling for slidably fastening the outer spring rib within a hole defined within the collar.

4. An automatic umbrella according to claim 1, wherein said central shaft means includes: the lower tube having an upper enlarged portion having a cross section of hexagonal shape to be engageable with the first middle tube having a cross section of hexagonal shape, the first middle tube having an upper enlarged portion having a cross section of triple-lobe shape to be engageable with the second middle tube having a cross section of triple-lobe shape and having a lower tube end of the first middle tube tapered downwardly to have a cross section of circular shape to be engageable with the lower tube, the second middle tube having a lower tube end thereof tapered downwardly and having a cross section of hexagonal shape to be engageable with the first middle tube and having an upper enlarged portion of said second middle tube having a cross section of circular shape to be engageable with the upper tube having a cross section of circular shape, and the upper tube having a lower tube end thereof tapered downwardly to have a cross section of triple-lobe shape to be engageable with the second middle tube.

5. An automatic umbrella according to claim 1, wherein each said closing spring of the plurality of the closing springs has an inner spring end of the closing spring secured to an inner portion of the inner connecting rib, and an outer spring end of the closing spring secured to an outer portion of the stretcher rib.

6. An automatic umbrella according to claim 1, wherein said control means includes: a push button resiliently held in a button hole formed in the grip having an upper latch integrally formed on a ring portion which is slidably held in at least a guiding groove transversely recessed in an inside wall of the grip, with the ring portion tapered from the push button from a first side of the central shaft means towards a second side of the shaft means to form a pair of reinforced side-wing portions disposed on opposite sides of the push button and each wing portion defined between the push button and the ring portion, and having the upper latch operatively actuated when simultaneously depressing the push button for opening the umbrella, a closing controller having a lower latch resiliently secured on an anti-false operation safety means resiliently held in the grip and the lower latch being operatively depressible by the push button for inwardly pushing a locking head, which is secured with a drag rod coupled to a drag rope which is repeatedly linked between an upper portion of the upper tube and the lower runner, for disengaging the locking head from a detent protrusion formed in a lower portion of the inner tube, thereby allowing each said closing spring to be restored to release its pre-stored elastic energy for closing the umbrella from an opened state, with the anti-false operation safety means having an elongated cylinder lowered by the two middle tubes after closing the umbrella to lower the latch to prevent a false depression of the closing controller without being depressed by the push button when opening the umbrella.

7. An automatic umbrella according to claim 6, wherein said drag rope includes: an inner rope end coupled to the drag rod, an outer rope end fixed to the lower runner, an upper guiding roller rotatably mounted by an upper pivot in an inner block secured in an upper portion of the upper tube for slidably guiding the drag rope from inside the upper tube and the central sleeve set held within the central shaft means and winding the rope on the upper guiding roller, a lower guiding roller rotatably mounted on the lower runner by a lower pivot for winding the rope as guided from said upper guiding roller, an uppermost guiding roller rotatably mounted on a top portion of the upper tube by an uppermost pivot and positioned above the upper roller for further winding the rope on the uppermost guiding roller from the lower guiding roller, with the outer rope end downwardly directed to be fixed to the lower runner.

8. An automatic umbrella according to claim 1, wherein said uppermost guiding roller is rotatably mounted on a circumference of the top of the upper tube by an uppermost pivot which is generally protectively perpendicular to an upper pivot having the upper guiding roller rotatably mounted thereon and the uppermost pivot is projectively parallel to a lower pivot of the lower guiding roller.

9. An automatic umbrella comprising:

a central shaft means including a plurality of tubes telescopically engageable with one another;

a rib assembly including at least a top rib pivotally secured to an upper notch formed on a top of said central shaft means, and a stretcher rib pivotally connected between said top rib and a lower runner slidably held on said central shaft means;

an opening spring retained in said central shaft means for opening the umbrella;

a plurality of closing springs retained on said rib assembly for closing the umbrella; and a control means having a push button slidably held in a grip secured on a lower portion of said central shaft means for controlling an opening and closing of the umbrella as effected by a drag rope provided on said shaft means and said rib assembly, and including an upper guiding roller rotatably mounted on an upper portion in said central shaft means for winding said rope as directed from an inside of said shaft means; a lower guiding roller rotatably mounted on the lower runner for winding said rope as downwardly directed from said upper roller; and an uppermost guiding means rotatably mounted on a top of said shaft means above said upper guiding roller for further winding the rope as guided from said lower roller, with said rope finally downwardly directed to and fixed on said lower runner.

10. An automatic umbrella according to claim 9, wherein said uppermost guiding means is an uppermost guiding wheel having a diameter generally equal to a diameter of the central shaft means and rotatably mounted on a top of the shaft means by an uppermost pivot transversely secured on the top of the shaft means and generally perpendicularly intersecting a longitudinal axis of the shaft means for symmetrically disposing an outer rope section of the drag rope on opposite sides of the uppermost pivot and disposed on opposite outer surfaces of the shaft means for dynamic balancing of a rope when folding and unfolding the umbrella.

11. An automatic umbrella according to claim 9, wherein said uppermost guiding means includes a pair of uppermost guiding rollers respectively rotatably mounted in opposite portions of an inner block by two uppermost pivots and positioned above the upper guiding roller for winding the rope on the two uppermost guiding rollers for disposing the rope on opposite outer surfaces of the shaft means for dynamically balancing the rope when operating the umbrella.

12. An automatic umbrella according to claim 9, wherein said central shaft means includes at least a tube having a cross section of triple-lobe shape.

* * * * *